US006948471B1

(12) United States Patent
Odashima

(10) Patent No.: US 6,948,471 B1
(45) Date of Patent: Sep. 27, 2005

(54) ENGINE LUBRICATING SYSTEM

(75) Inventor: Ryoetsu Odashima, Mori-machi (JP)

(73) Assignee: Kabushiki Kaisha YED, Mori-machi (JP)

( * ) Notice: Subject to any disclaimer, the term of this patent is extended or adjusted under 35 U.S.C. 154(b) by 0 days.

(21) Appl. No.: 10/708,728

(22) Filed: Mar. 20, 2004

(51) Int. Cl.[7] ..... F01M 5/00
(52) U.S. Cl. ..... 123/196 R
(58) Field of Search ..... 123/196 R, 196 A, 123/196 AB, 195 C, 195 A

(56) References Cited

U.S. PATENT DOCUMENTS 4,977,870 A * 12/1990 Hashimoto et al. ..... 123/195 C
5,199,395 A * 4/1993 Mizumura et al. .... 123/196 AB
5,647,315 A * 7/1997 Saito ..... 123/196 AB

FOREIGN PATENT DOCUMENTS

JP 6-299863(A) 10/1994

* cited by examiner

*Primary Examiner*—Henry C. Yuen
*Assistant Examiner*—Hyder Ali
(74) *Attorney, Agent, or Firm*—Ernest A Beutler

(57) ABSTRACT

An improved internal combustion engine lubricating system that includes an oil filter that is mounted on a mounting bracket that is fixed to a side face of an engine component that has direct communication with the oil pump and the engine main oil gallery to minimize the number of passages that must be sealed to prevent leakage and to make a more compact assembly.

16 Claims, 6 Drawing Sheets

ENGINE LUBRICATING SYSTEM

BACKGROUND OF INVENTION

This invention relates to an internal combustion engine and more particularly to the lubricating system for such engines.

As is well known, internal combustion engines require a lubricating system for providing lubricant to their moving components. In addition to the lubricating function, the lubricant also generally serves the function of cooling the engine, at least partially. With at least four cycle engines, the lubricating system includes a lubricant reservoir that stores the lubricant, an oil pump, that pressurizes the stored lubricant and circulates it through suitable passages to the lubricated areas and a return to the reservoir. Normally an oil filter is provided through which the circulated oil is passed to entrap foreign articles and prevent them from reaching the lubricated surfaces. Often the oil filter is associated with a heat exchanger to aid the cooling operation.

Thus the lubricating system requires a number of components, a drive for the pump or pumps, a filter arrangement and the formation and provision of the requisite passages for the lubricant flow, return and passage through the filter. Since the filter normally involves a cartridge that requires servicing, access and ease of servicing is important.

Japanese published application Hei 6-299863 shows a typical type of prior art approach to this problem. As seen therein, the engine has a cylinder block in which cylinder bores are formed. A bulkhead formed separately from the cylinder block and secured to its lower face acts with the cylinder block to support a crankshaft. A separate oil pan is secured to the lower face of the bulkhead and an oil pump driven by the crankshaft is supported on the bulkhead and depends into the oil pan. In addition to this construction conventionally the engine is provided with a bracket protruding from the engine body for removably securing an oil filter. The oil filter communicates with the engine through oil passages formed in the cylinder block, the bulkhead, and the bracket. Thus resulting in a complicated arrangement having a number of connecting joints that require effective sealing.

Another example of this complicated arrangement is shown in U.S. Pat. No. 5,647,315. That arrangement also adds an oil cooler to the oil filter body further complicating the plumbing of the oil and coolant passages. Also the mounting arrangement for the filter element is somewhat complicated and bulky.

It is therefore a principal object of the invention, to provide an effective oil filter mounting and connecting arrangement that reduces the number of connecting joints and permits more latitude in the filter mounting. In addition another object is to simplify and make the oil filter mounting more compact without adversely affecting serviceability.

SUMMARY OF INVENTION

This invention is adapted to be embodied in an internal combustion engine and lubricating system therefore. The engine is comprised of an engine body consisting of a cylinder block having at least one cylinder bore formed therein with a cylinder head assembly affixed to an end of the cylinder block in closing relation to the cylinder bore. A piston reciprocates in the cylinder bore and drives a crankshaft. A crankcase assembly is fixed to another end of the cylinder block assembly and cooperates with the cylinder block to journal the crankshaft. The crankcase assembly including an oil pan member for collecting lubricant from the engine. An oil pump is driven by the crankshaft and depends at least in part into the oil pan. A mounting pad is formed on a side surface of a single component of the engine. An oil delivery passage formed in the single component communicates with the oil pump and terminating at an oil delivery port opening through the side surface and within the mounting pad. An oil discharge passage for delivering filtered oil to the engine is also formed in the single component and begins at an oil discharge port opening through the side surface and within the mounting pad. The assembly is completed by an oil filter attaching bracket affixed to the mounting pad and adapted to detachably mount an oil filter.

DETAILED DESCRIPTION

Figure 1:
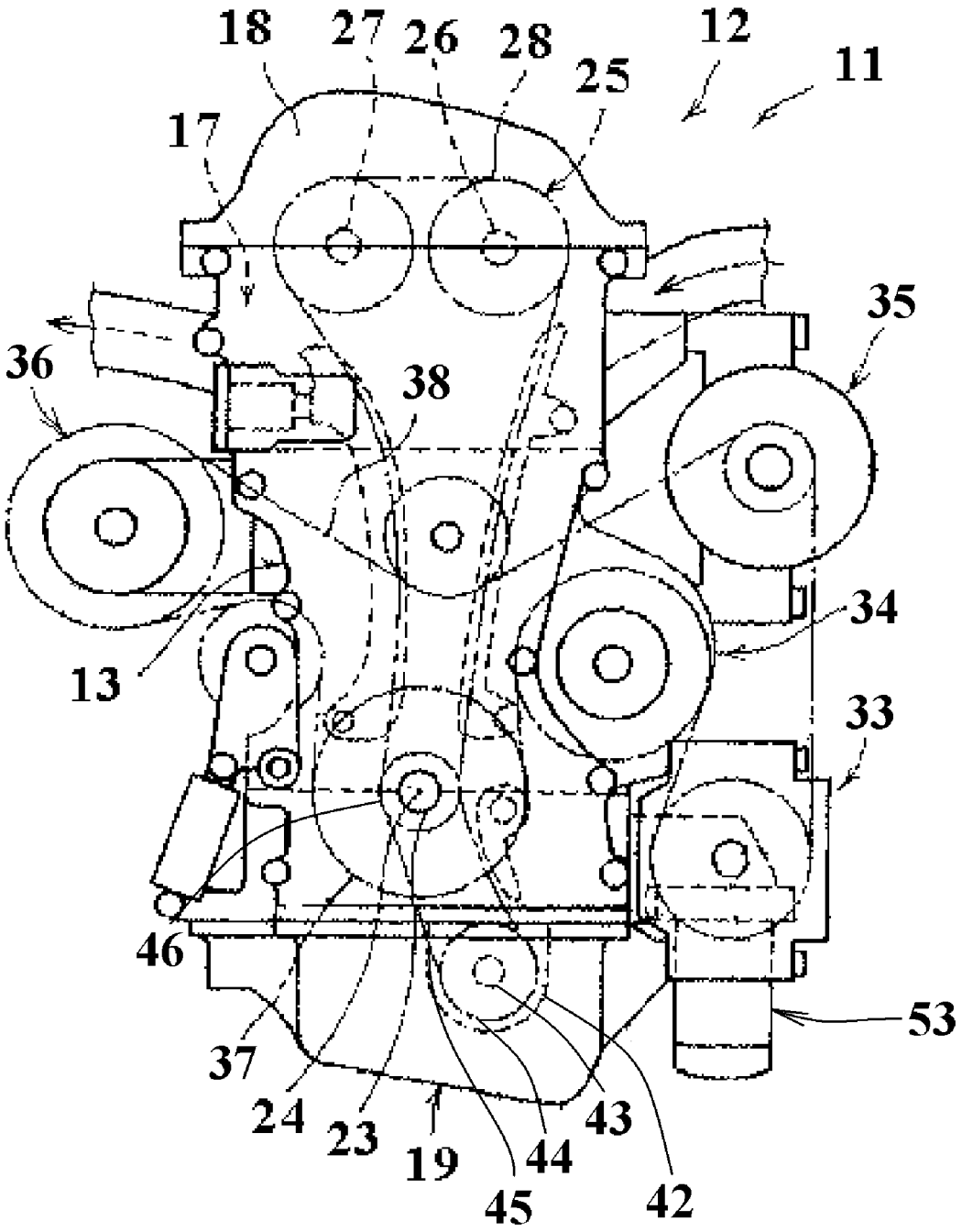
FIG. 1 is a front elevational view of an internal combustion engine and accessory drive constructed in accordance with an embodiment of the invention.
Figure 2:
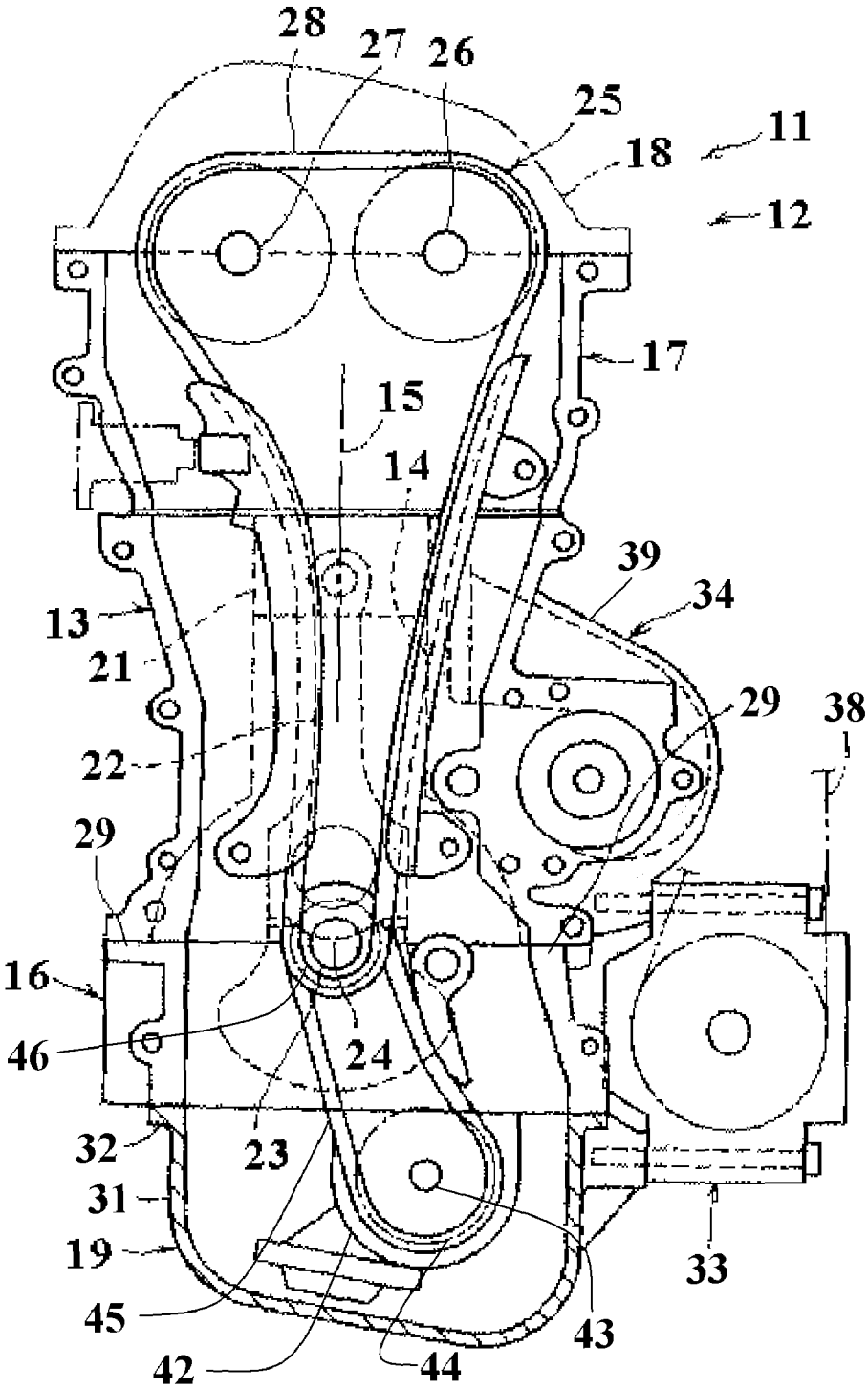
FIG. 2 is an enlarged front elevational view of the engine looking in the same direction as FIG. 1, but with the timing cover of the engine removed.
Figure 3:
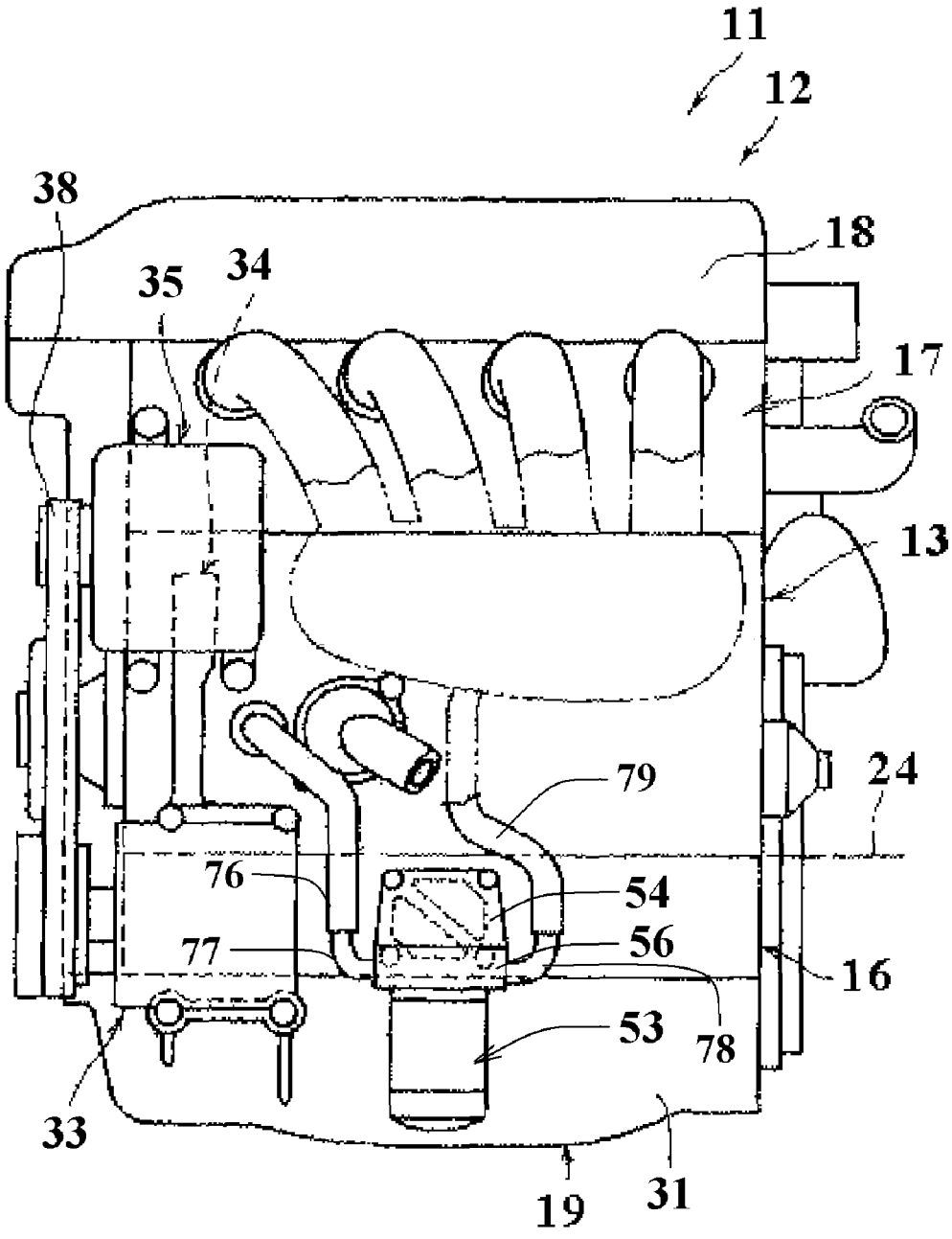
FIG. 3 is a side elevational view of the engine.

Referring now in detail to the drawings and initially primarily to FIGS. 1–3, a multi-cylinder, four-stroke internal combustion engine embodying the invention is indicated generally by the reference numeral 11. In the illustrated embodiment the engine 11 is shown as having four in line cylinders. Of course, from the following description it will be obvious to those skilled in the art, that the invention can be utilized with engines having other numbers of cylinders and other engine configurations. In addition the invention is not limited to engines operating on the four stroke principle.

The engine 11 is adapted to be mounted on and power a vehicle such as an automobile and is depicted as being mounted vertically therein, although the invention is not so limited. The engine 11 has an engine body, indicated generally at 12 supported in a suitable fashion by a vehicle body (not shown), engine body 12 is comprised of a cylinder block, indicated generally at 13. The cylinder block 13 is formed with four cylinder bores 14 (FIG. 2) having parallel axes 15. Detachably affixed, in a known manner, to the lower end of the cylinder block 13 is a bulkhead, indicated generally at 16, to form the upper portion of a crankcase assembly.

A cylinder head assembly 17 is secured to the upper face of the cylinder block 13 in a known manner and closed the upper ends of the cylinder bores 14. The cylinder head assembly 17 supports valves for controlling the admission of a charge into the engine combustion chambers and the discharge of exhaust gasses therefrom in any suitable manner and as is well known in this art. These valves are operated in a manner to be described. This valve and operating mechanism is enclosed by a cylinder head cover 18 that is secured to the upper face of the cylinder head 17.

The aforedescribed crankcase assembly, the upper portion of which is formed by the lower part of the cylinder block 13 and bulkhead 16 is completed and closed by an oil pan, indicated generally at 19, that is suitably secured to the lower face of the bulkhead 16 and contains lubricating oil.

The engine 11 is provided with pistons 21 reciprocating in the cylinder bores 14 and connected by connecting rods 22 to drive a crankshaft 23. The crankshaft 23 rotates about an axis 24 that extends generally horizontally. The crankshaft 23 is journalled about this axis 24 by bearings carried by the cylinder block 13 and bulkhead 16 in a manner well known in the art.

The aforementioned intake and exhaust valves are operated in a suitable manner by a valve actuating mechanism, indicated generally at 25. This valve actuating mechanism 25 is comprised of an intake camshaft 26 and an exhaust camshaft 27 in suitable operational engagement with the intake valves and exhaust valves, (not shown) respectively. The camshafts 26 and 27 haves axes that extend parallel to the axis 24 of the crankshaft 23. A timing chain 28 interconnects a sprocket provided on one end of the crankshaft 23 with sprockets on the ends of the camshafts 26 and 27 to drive them in timed relation at one half the rotational speed thereof.

As has been noted, the cylinder block 13 is made by casting, and preferably of low pressure cast aluminum with the cylinder head 17 formed of the same material and fixed to the upper face thereof in a known manner. The aforedescribed crankcase assembly and specifically an upper flange 29 of the bulkhead 16 is affixed thereto in any suitable manner. Oil pan 19 has a generally dish-shaped oil pan body 31 opening upward and an outward flange 32 formed integrally with the upper outer edge of the oil pan body 31 that is sealingly engaged with the lower face of the bulkhead 16 to add to the rigidity of the structure.

The engine 11 is provided with a number of accessories disposed in the outer lateral vicinity of the engine body 12. Some of these accessories are for engine operation while others are for vehicle or other purposes. These include an air compressor 33 for vehicle air conditioning, an engine coolant pump 34 for delivering coolant to a coolant jacket formed in the engine body 12 to cool the engine body 12, an alternator 35 for generating electrical power for the vehicle and engine ignition, and a power steering pump 36 for power assist of the vehicle steering. Each of these accessories 33, 34, 35 and 36 are driven in a well known manner from a pulley 37 that is affixed to the crankshaft 23 by means of a serpentine belt 38.

As has been noted, the engine driven accessories include the coolant pump 34. This pump 34 has an outer housing that is integral with the cylinder block 13 and thus reinforces it. This outer housing includes a discharge duct portion 39 that communicates with cooling jackets 41 (FIG. 2) formed in the cylinder block 13 around the cylinder bores 14. These cooling jackets 41 also cooperate with cooling jackets (not shown) formed in the cylinder head 17. The coolant also passes through a heat exchanger (not shown) in a manner well known in the art.

In addition to the cooling system just described and in accordance with the invention, the engine 11 is provided with a lubricating system that includes the crankcase assembly and specifically the oil pan 19. The lubricant is supplied by this system to portions of the engine 11 to be lubricated such as bearings for the crankshaft 23 and the camshafts 26, 27. The lubricating system is provided with an oil pump 42 supported directly on the bulkhead 16 so that it protrudes downward from the lower face of the bulkhead 16 to be disposed in the oil pan 19.

Figure 4:
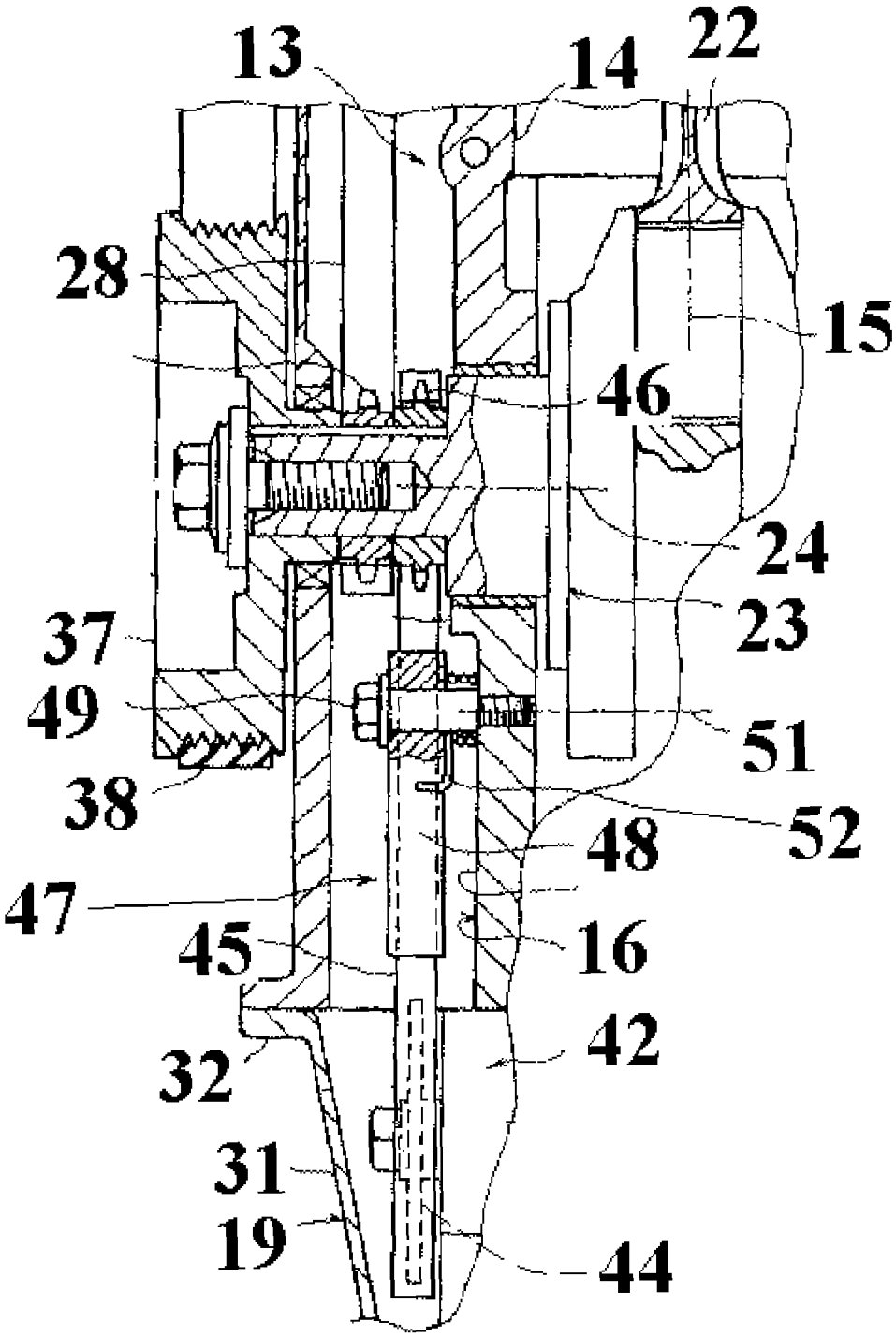
FIG. 4 is an enlarged cross sectional taken along the line 4—4 in FIG. 2.

The oil pump 42 may be of any known type and has a drive shaft 43 to which a sprocket 44 affixed to an end thereof that extends outwardly in the oil pan 19. The sprocket 44 is driven by a driving chain 45 that is driven in turn by a sprocket 46 fixed to one end of the crankshaft 23. This drive will now be described in more detail by primary reference to FIG. 4. There is provided a tensioner mechanism, indicated generally by the reference numeral 47, for maintaining the desired tension in the oil pump driving chain 45. The tensioner 47 is includes a tension arm 48, one end of which is pivoted on the bulkhead 16 by a pivot shaft 49, so that the other end can be rotated about an axis 51 defined by the pivot shaft 49. The other end of the arm 48 is urged into contact with the chain 45 by a spring 52 to maintain the desired tension.

The oil pump 42 supplies its pumped lubricant to the lubricated components of the engine 11 through a feed system that includes a removable oil filter of the cartridge type, indicated generally by the reference numeral 53. This is mounted on the engine 11 and particularly on the bulkhead 16 by a mounting bracket, indicated generally at 54 as shown best in FIG. 6. This mounting bracket 54 is affixed, in a manner to be described shortly, on a mounting pad 55 formed integrally on a side face of the bulkhead 16.

Figure 5:
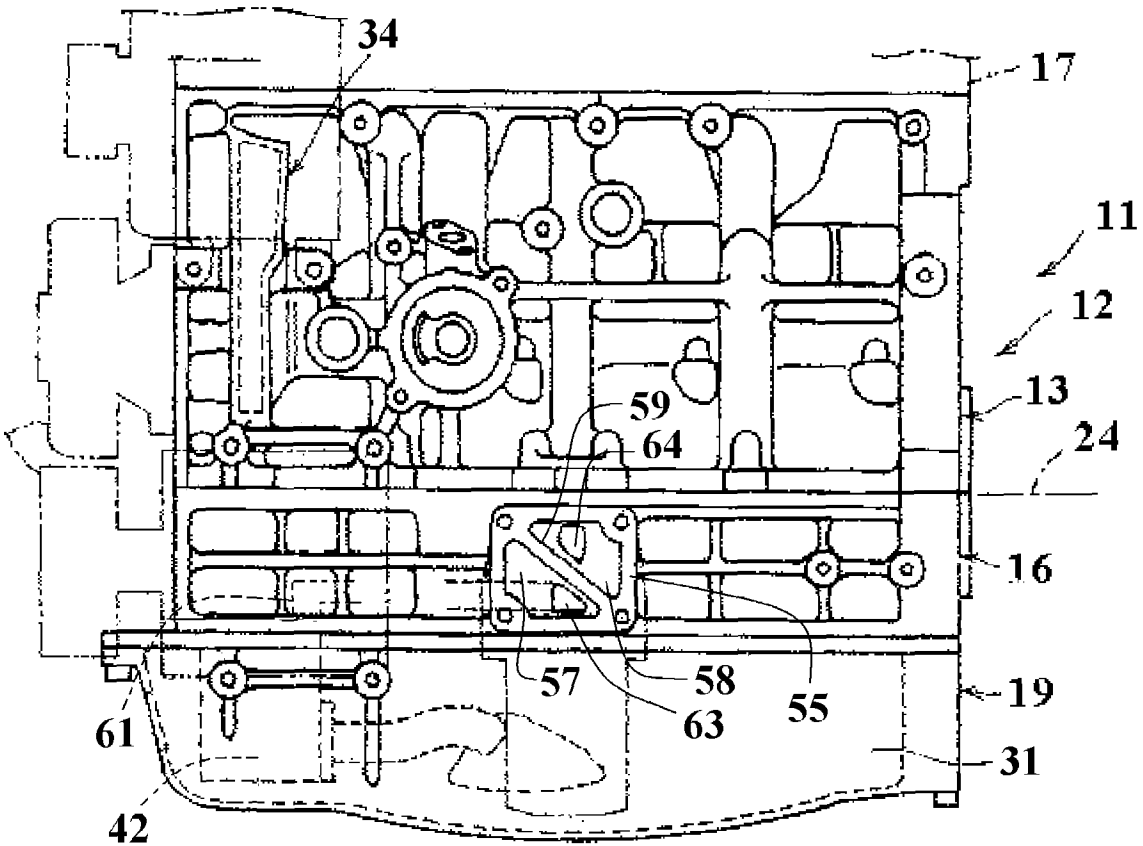
FIG. 5 is a side elevational view looking in the same direction as FIG. 3, showing only the assembled cylinder block and crankcase assembly in solid lines and some of the engine accessories in phantom.

In addition to carrying the oil filter 53, the mounting bracket 54 carries an oil cooler, indicated generally by the reference numeral 56. This oil cooler 56 is interposed, in a manner to be described shortly, between the mounting bracket 54 and the oil filter 53. Referring now additionally to FIG. 5, it will be seen that the mounting pad 55 is formed as an outward projection of the side face of the bulkhead 16 and defines an inlet cavity 57 and a discharge cavity 58 that are separated by an angularly disposed dividing wall 59.

Figure 6:
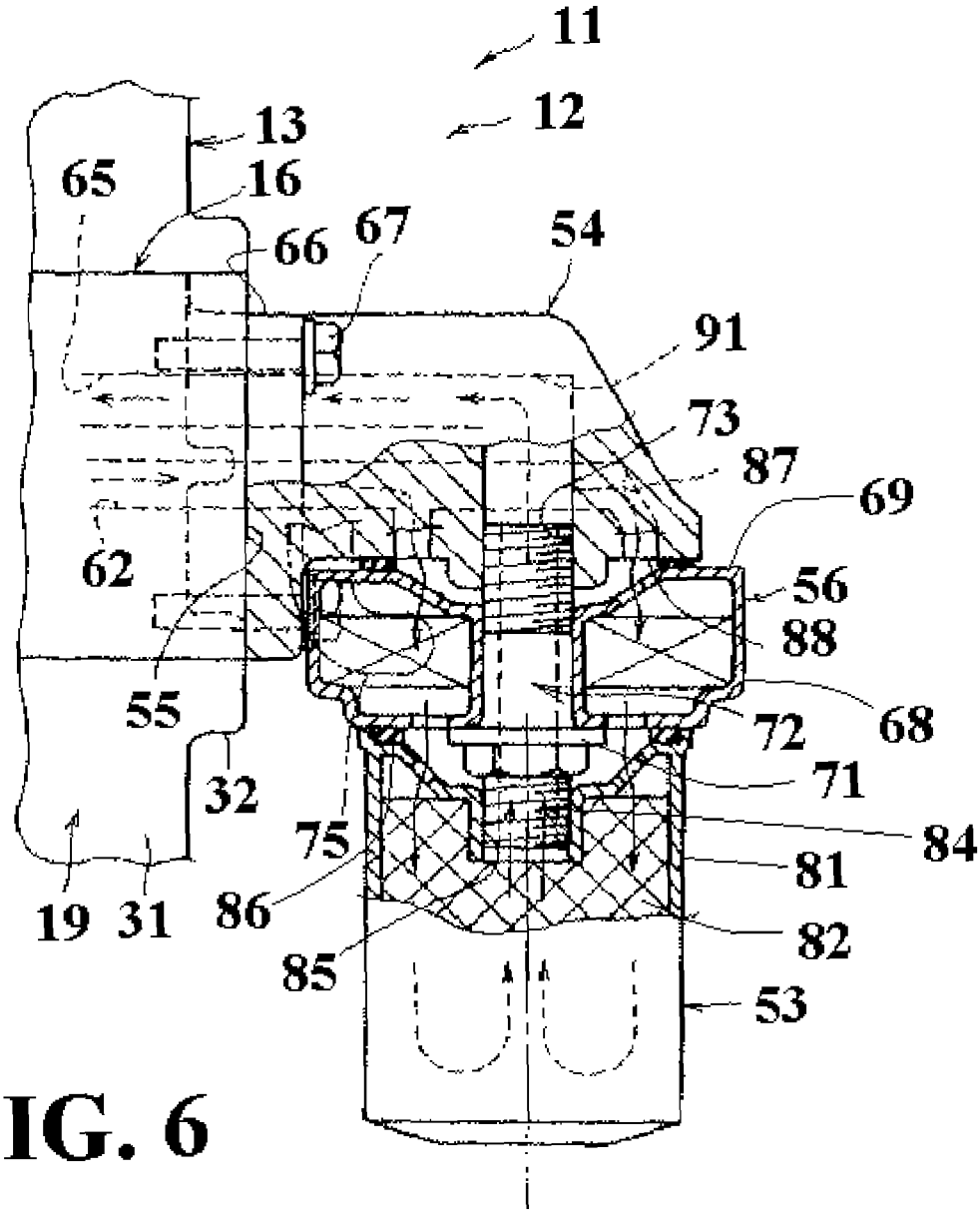
FIG. 6 is an enlarged view looking in the same direction as FIG. 1, of the oil filter and mounting arrangement therefore with portions broken away and shown in section.

Continuing to refer primarily to FIGS. 5 and 6, it will be seen that the oil pump 42 discharges the pumped oil in a vertical direction to enter a vertically extending passage 61 that extends in the bulkhead 16 from its lower face. This vertical passage 61 intersects a horizontal passage 62 that terminates in the inlet cavity 57 of the mounting pad 55 via an opening 63.

After passing through the oil cooler 56 and the filter 53, in a manner to be described shortly, the cooled and filtered lubricant is delivered to the discharge cavity 57 for delivery to the lubricated components of the engine 11 through an opening 64 of the main oil gallery of the engine 11 that is formed initially in the bulkhead 16. The opening 64 communicates with the initial part of the main oil gallery, indicated by the reference numeral 65, that is formed in the bulkhead 16 as seen in FIG. 6. From there the oil passes to the aforenoted lubricated components of the engine through suitable passages, as is well known in the art.

Continuing to refer primarily to FIG. 6, it will be seen that the mounting bracket 54 which is formed separately from the bulkhead 16 has a pair of side flanges 66 that have openings for receiving fasteners 67 for removable attachment to the mounting pad 55 formed on the outer lateral face of the bulkhead 16.

The oil cooler 56 has an outer housing 68 of a generally ring shape with a generally flat upper surface 69 that is held in sealing relation with a mating lower surface of the mounting bracket 54 by means of a shoulder 71 of a fastener, indicated generally by the reference numeral 72. The fastener 72 has a threaded portion 73 that is received in a tapped opening of the mounting bracket 54 to load a sealing gasket 74 between the mating face 69 of the oil cooler 56 and the mounting bracket 54.

Positioned within the oil cooler body 69 is a heat exchanger 75 that receives engine coolant from the engine cooling jacket 41 via a conduit 76 and fitting 77 (FIG. 3). After this coolant passes through the heat exchanger 75 it is returned to the cooling jacket 41 via a return fitting 78 and return conduit 79.

Referring again to FIG. 6, the oil filter 53, as has already been noted, is of the canister type and includes a can shaped outer housing 81 in which a filter media of any desired type 82 is received. This outer housing is formed with an end wall 83 having a tapped opening 84 that is threaded onto a lower threaded portion 85 of the fastener 72. A sealing ring 86 is thus sealingly compressed between the end wall 83 and the lower face of the heat exchanger body 68.

The cylinder block oil passage 62 mates with an oil delivery passage 87 formed in the mounting bracket 54 that terminates in a plurality of downwardly opening passages to communicate with the upper wall of the oil cooler 56 in the area inwardly of the sealing gasket 74. The oil cooler outer housing has a plurality of openings 88 in this area to permit oil to enter into the oil cooler 56 for cooling in the direction indicated by the arrows.

In a like manner the lower wall of the oil cooler housing 68 has a plurality of discharge openings to permit the oil to enter the area of the oil filter end wall 83 inwardly of the sealing ring 86 again as shown by the flow indicating arrows. The oil then enters the oil filter 53 to flow through the filter media 82 through openings in the end wall 83 as also shown by the flow indicating arrows.

The thus cooled and filtered oil then exits the filter 53 and cooler 56 through an internal passage 89 formed in the fastener 72. The oil then flows into a delivery passage 91 formed in the mounting bracket 54, as again shown by the flow arrows. The delivery passage 91 in turn communicates with the initial part 65 of the engine main oil gallery formed in the bulkhead 16 to deliver the cooled and filtered oil to the engine 11. After the lubrication, the lubricating oil is returned to the oil pan 19 in any known manner for repeated delivery by the oil pump 42.

In the above case, the oil filter 53 and the oil cooler 56 are both located on an axis defined by the fastener 72. The lubricating oil flows in an axial direction evenly through the oil filter 53 and the oil cooler 56, and returns through the passage 89 in the fastener 72. Thus, the filtration of the lubricating oil by the oil filter 53 and the cooling by the oil cooler 56 can be achieved effectively.

Since all of the oil delivery passages and return passages between the oil pump 42, the oil cooler 56, oil filter 53 and the engine lubricating main gallery 65 are formed in a single engine body piece, in this case the bulkhead 16, the number and location of sealing surfaces required by the prior art constructions is substantially reduced with not only cost savings but good insurance against leakage. Also, since the bracket 54 is a separate body from the bulkhead 16, it is possible to select a variety of postures and positions of the oil filter 53 and the oil cooler 56, which are secured to the bracket 54, by selecting a variety of shapes of the bracket 54. Therefore, adoption of suitable postures and positions of the oil filter 53 and the oil cooler 56 permits arranging the engine body 12, the oil filter 53, and the oil cooler 56 in a compact manner, thereby preventing the lubricating system from being oversized.

Of course those skilled in the art will readily understand that the described embodiment is only exemplary of forms that the invention may take and that various changes and modifications may be made without departing from the spirit and scope of the invention, as defined by the appended claims. For examples only, the engine 11 may be a two-stroke engine and/or the axes 15 of the cylinder bores 14 may be inclined with respect to the vertical.

What is claimed is:

1. An internal combustion engine and lubricating system therefore comprised of an engine body consisting of a cylinder block having at least one cylinder bore formed therein, a cylinder head assembly affixed to an end of said cylinder block in closing relation to said cylinder bore, a piston reciprocating in said cylinder bore and driving a crankshaft, a crankcase assembly fixed to another end of said cylinder block and cooperating with said cylinder block to journal said crankshaft, said crankcase assembly including an oil pan member for collecting lubricant from said engine, an oil pump driven by said crankshaft and depending at least in part into said oil pan, a mounting pad formed on a side surface of a single component of said engine, an oil delivery passage communicating with said oil pump formed in said single component and terminating at an oil delivery port opening through said side surface and within said mounting pad, an oil discharge passage for delivering filtered oil to said engine formed in said single component and beginning at an oil discharge port opening through said side surface and within said mounting pad, and an oil filter attaching bracket affixed to said mounting pad and adapted to detachably mount an oil filter.

2. An internal combustion engine and lubricating system as set forth in claim 1, wherein the single component is a component of the crankcase assembly.

3. An internal combustion engine and lubricating system as set forth in claim 2, wherein the single component is a bulkhead to which the oil pan member is affixed.

4. An internal combustion engine and lubricating system as oct forth in claim 1, further including a bulkhead forming a portion of the crankcase assembly affixed to a lower surface of the cylinder block and journaling the crankshaft with the cylinder block, the oil pan being fixed to a lower face of said bulkhead.

5. An internal combustion engine and lubricating system as set forth in claim 4, wherein the oil pump is supported by the bulkhead.

6. An internal combustion engine and lubricating system as set forth in claim 5, wherein the single component is the bulkhead.

7. An internal combustion engine and lubricating system as set forth in claim 6, wherein the oil pump has a discharge port communicating directly with the bulkhead.

8. An internal combustion engine and lubricating system therefore comprised of an engine body consisting of a cylinder block having at least one cylinder bore formed therein, a cylinder head assembly affixed to an end of said cylinder block in closing relation to said cylinder bore, a piston reciprocating in said cylinder bore and driving a crankshaft, a crankcase assembly fixed to another end of said cylinder block and cooperating with said cylinder block to journal said crankshaft, a bulkhead forming a portion of said crankcase assembly affixed to a lower surface of said cylinder block and journaling said crankshaft with said cylinder block, said oil pan being fixed to a lower face of said bulkhead, said crankcase assembly including an oil pan member for collecting lubricant from said engine, an oil pump supported by said bulkhead and driven by said crankshaft and depending at least in part into said oil pan, said oil pump has a discharge port communicating directly with said bulkhead, a mounting pad formed on a side surface of said bulkhead, an oil delivery passage communicating with said oil pump formed in said bulkhead and terminating at an oil delivery port opening through said side surface and within said mounting pad, an oil discharge passage for delivering filtered oil to said engine formed in said bulkhead and beginning at an oil discharge port opening through said side surface and within said mounting pad, and an oil filter attaching bracket affixed to said mounting pad and adapted to detachably mount an oil filter, said mounting pad defining a pair of fluid cavities separated by a dividing wall, one of said cavities being in direct communication with said oil delivery passage, the other of said cavities communicating with said oil discharge passage.

9. An internal combustion engine and lubricating system therefore comprised of an engine body consisting of a cylinder block having at least one cylinder bore formed therein, a cylinder head assembly affixed to an end of said cylinder block in closing relation to said cylinder bore, a piston reciprocating in said cylinder bore and driving a crankshaft, a crankcase assembly fixed to another end of said cylinder block and cooperating with said cylinder block to journal said crankshaft, said crankcase assembly including an oil pan member for collecting lubricant from said engine, an oil pump driven by said crankshaft and depending at least in part into said oil pan, a mounting pad formed on a side surface of a single component of said engine, an oil delivery passage communicating with said oil pump formed in said single component and terminating at an oil delivery port opening through said side surface and within said mounting pad, and oil discharge passage for delivering filtered oil to said engine formed in said single component and beginning at an oil discharge port opening through said side surface and within said mounting pad, and an oil filter attaching bracket affixed to said mounting pad and adapted to detachably mount an oil filter, an oil cooler supported by said oil filter attaching bracket and disposed between said oil filter attaching bracket and said oil filter for cooling the oil delivered to said oil filter.

10. An internal combustion engine and lubricating system as set forth in claim 9, wherein the single component is a component of the crankcase assembly.

11. An internal combustion engine and lubricating system as set forth in claim 10, wherein the single component is a bulkhead to which the oil pan member is affixed.

12. An internal combustion engine and lubricating system as set forth in claim 9, further including a bulkhead forming a portion of the crankcase assembly affixed to a lower surface of the cylinder block and journaling the crankshaft with the cylinder block, the oil pan being fixed to a lower face of said bulkhead.

13. An internal combustion engine and lubricating system as set forth in claim 12, wherein the oil pump is supported by the bulkhead.

14. An internal combustion engine and lubricating system as set forth in claim 13, wherein the single component is the bulkhead.

15. An internal combustion engine and lubricating system as set forth in claim 14, wherein the oil pump has a discharge port communicating at its inlet end directly with the bulkhead.

16. An internal combustion engine and lubricating system as set forth in claim 15, wherein the mounting pad formed on the bulkhead defines a pair of fluid cavities separated by a dividing wall, one of said cavities being in direct communication with the oil delivery passage, the other of said cavities communicating with the oil discharge passage.

* * * * *